US006389607B1

(12) United States Patent
Wood

(10) Patent No.: US 6,389,607 B1
(45) Date of Patent: May 21, 2002

(54) SOFT FOAM SPORT HELMET

(76) Inventor: James C. Wood, 395 N. Perry Pkwy. #O4, Perry, GA (US) 31069

( * ) Notice: Subject to any disclaimer, the term of this patent is extended or adjusted under 35 U.S.C. 154(b) by 0 days.

(21) Appl. No.: 09/670,305

(22) Filed: Sep. 26, 2000

(51) Int. Cl.[7] ..... A63B 71/10
(52) U.S. Cl. ..... 2/425; 2/411
(58) Field of Search ..... 2/414, 425, 411, 2/412, 422

(56) References Cited

U.S. PATENT DOCUMENTS

| | | | | |
|---|---|---|---|---|
| 2,140,716 A | * | 12/1938 | Pryale | |
| 2,908,943 A | * | 10/1959 | Miller | |
| 3,818,508 A | | 6/1974 | Lammers et al. | 2/3 R |
| 3,866,243 A | | 2/1975 | Morgan | 2/3 R |
| 4,477,929 A | | 10/1984 | Mattson | 2/425 |
| 4,754,501 A | | 7/1988 | Yahn | 2/424 |
| 4,808,469 A | | 2/1989 | Hiles | 428/318.6 |
| 4,845,786 A | | 7/1989 | Chiarella | 2/412 |
| 4,853,980 A | | 8/1989 | Zarotti | 2/413 |
| 5,010,598 A | | 4/1991 | Flynn et al. | 2/410 |
| 5,056,162 A | | 10/1991 | Tirums | 2/412 |
| 5,088,130 A | | 2/1992 | Chiarella | 2/411 |
| 5,150,479 A | | 9/1992 | Oleson | 2/414 |
| 5,177,815 A | | 1/1993 | Andujar | 2/411 |
| 5,272,773 A | * | 12/1993 | Kamata | |
| 5,309,576 A | | 5/1994 | Broersma | 2/412 |
| 5,361,420 A | | 11/1994 | Dobbs et al. | 2/425 |
| 5,412,810 A | | 5/1995 | Taniuchi | 2/424 |
| 5,426,972 A | | 6/1995 | Murasko | 2/422 |
| 5,477,563 A | | 12/1995 | Gentes et al. | 2/411 |
| 5,517,698 A | | 5/1996 | Nault et al. | 2/424 |
| 5,598,588 A | | 2/1997 | Lee | 2/421 |
| 5,603,117 A | | 2/1997 | Hudner, Jr. et al. | 2/6.6 |
| 5,655,227 A | | 8/1997 | Sundberg et al. | 2/414 |
| 5,713,082 A | * | 2/1998 | Bassette et al. | |
| 5,745,923 A | | 5/1998 | Katz | 2/411 |
| 5,930,841 A | | 8/1999 | Lampe et al. | 2/411 |
| 5,950,244 A | | 9/1999 | Fournier et al. | 2/414 |
| 6,108,825 A | * | 8/2000 | Bell et al. | |

FOREIGN PATENT DOCUMENTS

| | | | |
|---|---|---|---|
| DE | 2746897 A1 | * | 4/1979 |
| FR | 2294659 | * | 7/1976 |

* cited by examiner

*Primary Examiner*—Rodney M. Lindsey
(74) *Attorney, Agent, or Firm*—Stratton Ballew PLLC

(57) ABSTRACT

A protective sports helmet that is molded from a shock absorbing foam. The helmet is preferably an single, homogenous piece of injection molded foam. An insert plate can be positioned near the user's forehead at the top and forward portion of the helmet. The purpose of the insert plate is to simulate the hardness of the user's head for heading a ball. The helmet can head the ball without the injury to the head and the brain as potentially encountered without protection. The soft-shell also minimizes injuries on other parts of the body that are struck by the helmet. The helmet can be utilized for football and other contact sports. Additional external components such as metal or plastic inserts can be inset molded into the foam. The purpose of these inserts is to improve stability and allow for attachment of face guards and chin straps.

20 Claims, 11 Drawing Sheets

SOFT FOAM SPORT HELMET

TECHNICAL FIELD

The invention relates generally an athletic helmet formed from a soft, shock absorbent foam. Variations of the helmet can be used for sports such as football, hockey, soccer, and bicycling Specifically, the sport helmet of the present invention includes a molded piece of soft foam and alternatively includes metal or plastic inserts.

BACKGROUND OF THE INVENTION

Athletic head protection is necessary for prevention of head injuries in many sports. Contact sports such as football and hockey require the use of head protection. Other sports such as soccer may soon require head protection due to the significant potential of head injuries occurring from "heading" the ball and contact with other players.

The current football helmet technology teaches the use of a hard plastic shell with several interior foam inserts and air bladders for padding the head of the user wearing the helmet. The problem with the hard shell helmet is that the helmet itself can cause injury. When the helmet contacts or "hits" an unprotected body part such as an arm, leg, chest or hand, the contacted body part can sustain injuries such as bruises or broken bones within.

A softer helmet would certainly reduce these injuries. Contact with a soft object is much less intrusive than contact with a hard object. A plastic and foam helmet that attempts to address this need is shown in U.S. Pat. No. 5,745,923 to Katz. However, Katz '923 fails to provide protection against glancing hits by a ball or another helmet. Katz '923 also includes internal reinforcing elements within the foam portions of the helmet. Such reinforcing elements are expensive to manufacture. A soft helmet is needed that does not require such reinforcing elements to cushion a user.

Another foam helmet is shown in U.S. Pat. No. 5,177,815 to Andujar. It teaches the attachment of pad members to the exterior of a base member made of a resilient foam. Andujar '815, though providing some protection against glancing blows, still has failings. The pad members of Andujar '815 extend from the surface of the helmet and are undesirable in that they can be peeled away under normal use and impacts. Additionally, Andujar '815 fails to provide adequate protection to the user against more severe impacts as required for bicycle helmets, contact sports such as football and hockey, and desirable for soccer. A foam helmet is needed that provides approximately the same level of impact protection as conventional hard shell helmets, and yet provides the user with the ability to head soccer balls or deflect glancing hits to the helmet.

SUMMARY OF INVENTION

The present invention provides a soft, shock absorbent sport helmet. The sport helmet has a shell formed of a single, homogeneous component. The shell is formed by molding a soft foam material into the desired shape, preferably by the process of injection molding. The soft foam of the shell has a pliable form. The soft foam resists against an impact into the shell by compressing with the impact and then returning to the shell's original shape. The shell also includes a cranial support. The cranial support is attached to an interior surface of the shell. Alternatively, the cranial support is an element of the single, homogenous shell. The cranial support, which is preferably a plurality of cranial supports, contacts the head of a user to support the shell.

In a preferred alternative embodiment of the present invention, the shell includes an insert plate molded onto and exposed on an exterior surface of the shell. The insert plate is formed from a substantially rigid material and is ideal for heading a soccer ball or deflecting impacts with other helmets, as often occurs in football. The insert plate provides the advantage of protection against glancing hits by a ball or another helmet. Additionally, the insert plate does not protrude from the smooth exterior surface of the shell, thereby substantially eliminating the possibility of the pads ripping off the helmet on a glancing impact.

The helmet of the present invention does not require reinforcing elements to cushion a user. The foam of the helmet is dense enough to hold together without the need for reinforcing elements. With the aid of the cranial supports, the helmet provides approximately the same level of impact protection as conventional hard shell helmets. However, the supporting infrastructure is absent.

In an alternative embodiment of the helmet of the present invention, a holding plate is molded within the shell and partially exposed on an exterior surface of the shell. The holding plate can receive a helmet attachment, such as a chin strap, face mask or eye shield.

The present invention provides the advantage of improved head protection and a reduction of injuries that are caused from hard shell helmets. The invention also provides the advantage of a helmet that can rebound a ball from its frontal area, thereby allowing a substantially safe header by the user. The invention will be better understood by reference to the following detailed description taken in conjunction with the accompanying drawings.

DETAILED DESCRIPTION OF SPECIFIC EMBODIMENTS

Figure 1:
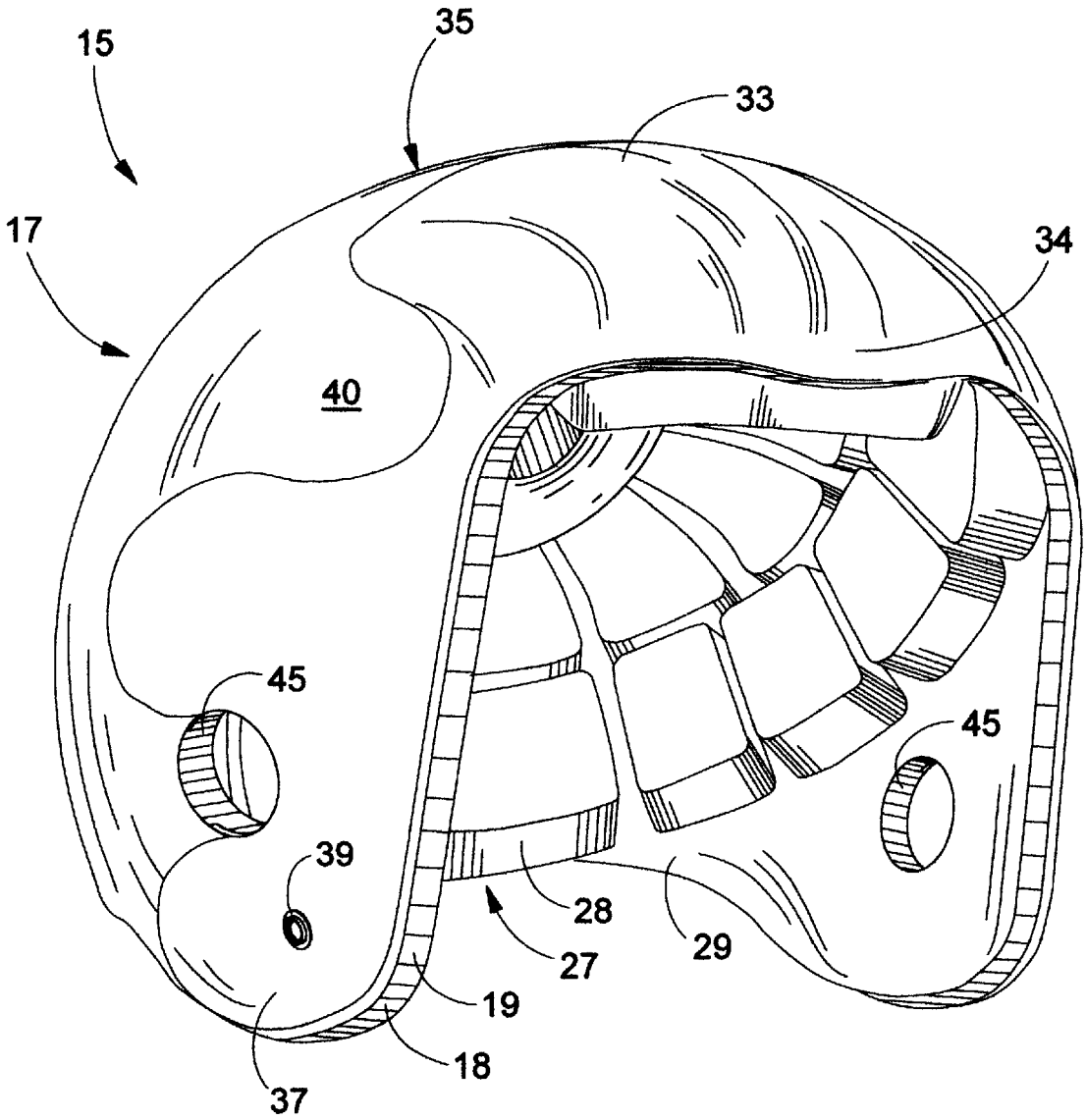
FIG. 1 is a perspective view of a sport helmet, according to an embodiment of the invention.

The present invention provides a helmet 15, as shown in FIGS. 1 through 11. The helmet is uniquely suitable for use in sports or athletics, most preferably of a non-motorized nature. Chief advantages of this helmet over conventional helmets are improved head protection, reduced weight, and reduction of injuries to the body parts that helmets typically make contact with. The helmet has a shell 17 formed of a single, homogeneous component 18. The homogeneous component of the shell is formed by molding a soft foam material 19. The soft foam material is pliable in form. This shell of soft foam material resists against impacts compressing with the impact and then returning to the shell's original shape.

The shell 17 of the helmet 15 of the present invention is substantially homogeneous in that it is uniform in its make-up and form. The soft foam material 19 making up the homogeneous component 18 of the shell is preferably a high-impact polyurethane foam. It is well known to prepare flexible polyurethane by the polymerization of polyols with isocyanates. Existing applications for these flexible polyurethane foams include hospital castings to protect injuries, and for seats in aircraft and automobiles. One such polyurethane foam considered for use in the present invention is a CONFOR® type foam, manufactured by Aearo Co., of Indianapolis, Ind., U.S.A.

To provide better cushioning performance in cold weather, other thermoplastic foams are preferred for use in manufacturing the present invention. Generally, certain polyolefin foams have the ability to provide the desired characteristics for the shell 17 of the helmet 15. Specifically, ethylene-vinyl acetate, polyethylene and polypropylene are thermoplastic materials considered for use with the present invention. Substantially homogeneous mixtures of these thermoplastics materials are also considered as possible alternative foams. "Macro-blends" of thermoplastic materials can create substantially homogeneous foams that have superior impact resistance. One such blend is TYPLAX™ structural foam, as manufactured by Polytyplax Technology, Inc. of New Haven Conn., U.S.A., which blends styrene/butadiene rubber (SBR) with specific polyolefins to form a hybrid foam mixture having superior impact resistive properties and cold temperature performance.

A preferred process for manufacturing the helmet 15 of the present invention is injection molding. The term "injection molding" broadly describes a range of conventional methods of forming thermoplastic materials. A type of injection molding that is preferably employed for the present invention is "gas-assist" foam molding. In gas-assist injection molding, the soft foam material 19 of the present invention is formed by mixing a pelletized plastic resin with a gaseous blowing agent. The melted resin and the blowing agent together form the foam material. The resultant mixture is injected into the mold. As soon as the plastic foam cools to a solid state, the mold opens and the finished shell 17 is ejected.

An additional injection molding technique that is preferably employed with the present invention is by "counter-pressurization" of the mold cavity, which prepressurizes the mold, immediately prior to the injection of the soft foam material 19 into the mold. This prepressurization of the mold cavity prevents bubbles from forming on the surface of the shell 17.

Figure 2:
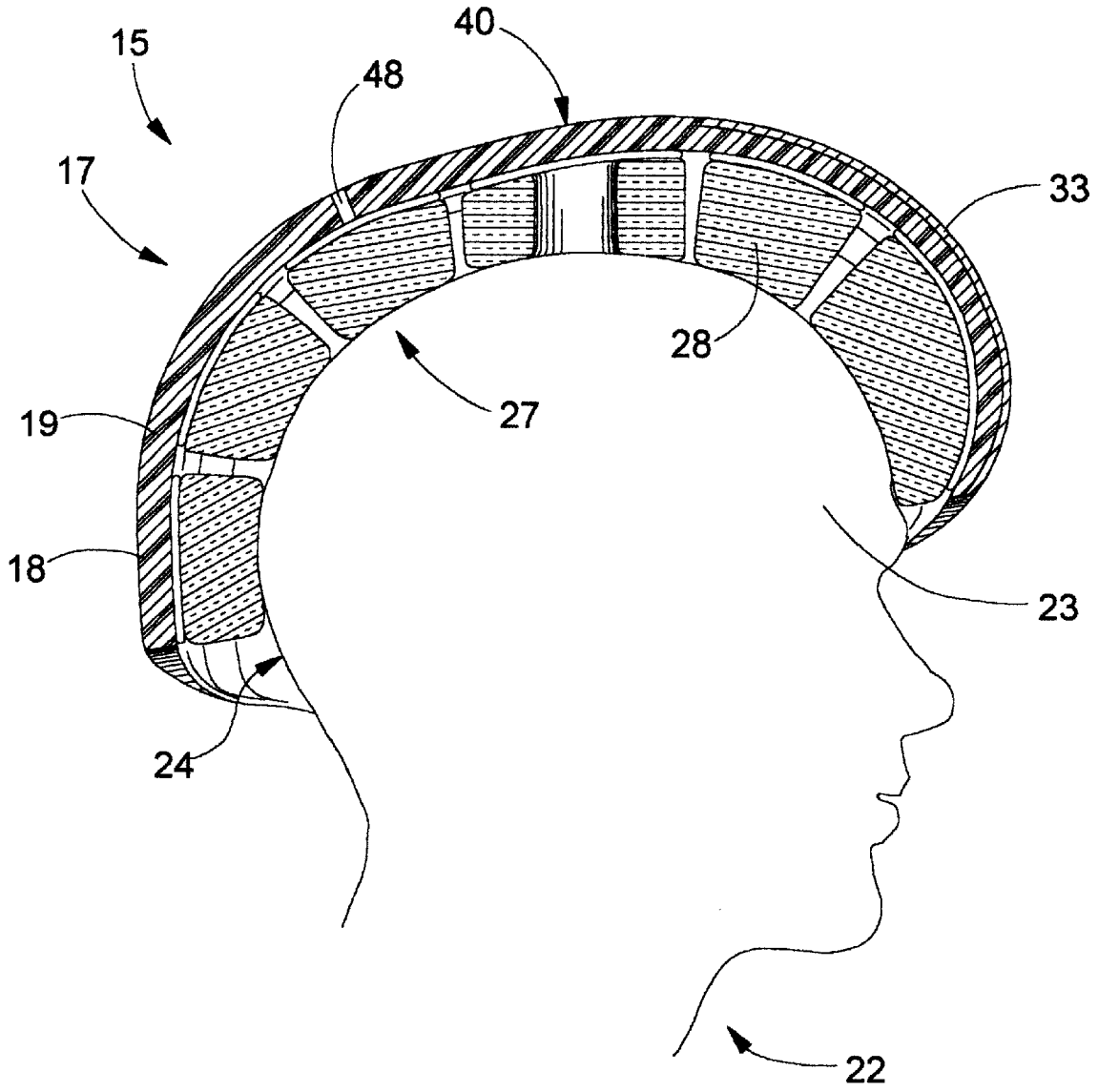
FIG. 2 is a vertically sectioned view of a sport helmet, shown worn by a user, according to an embodiment of the invention.
Figure 3:
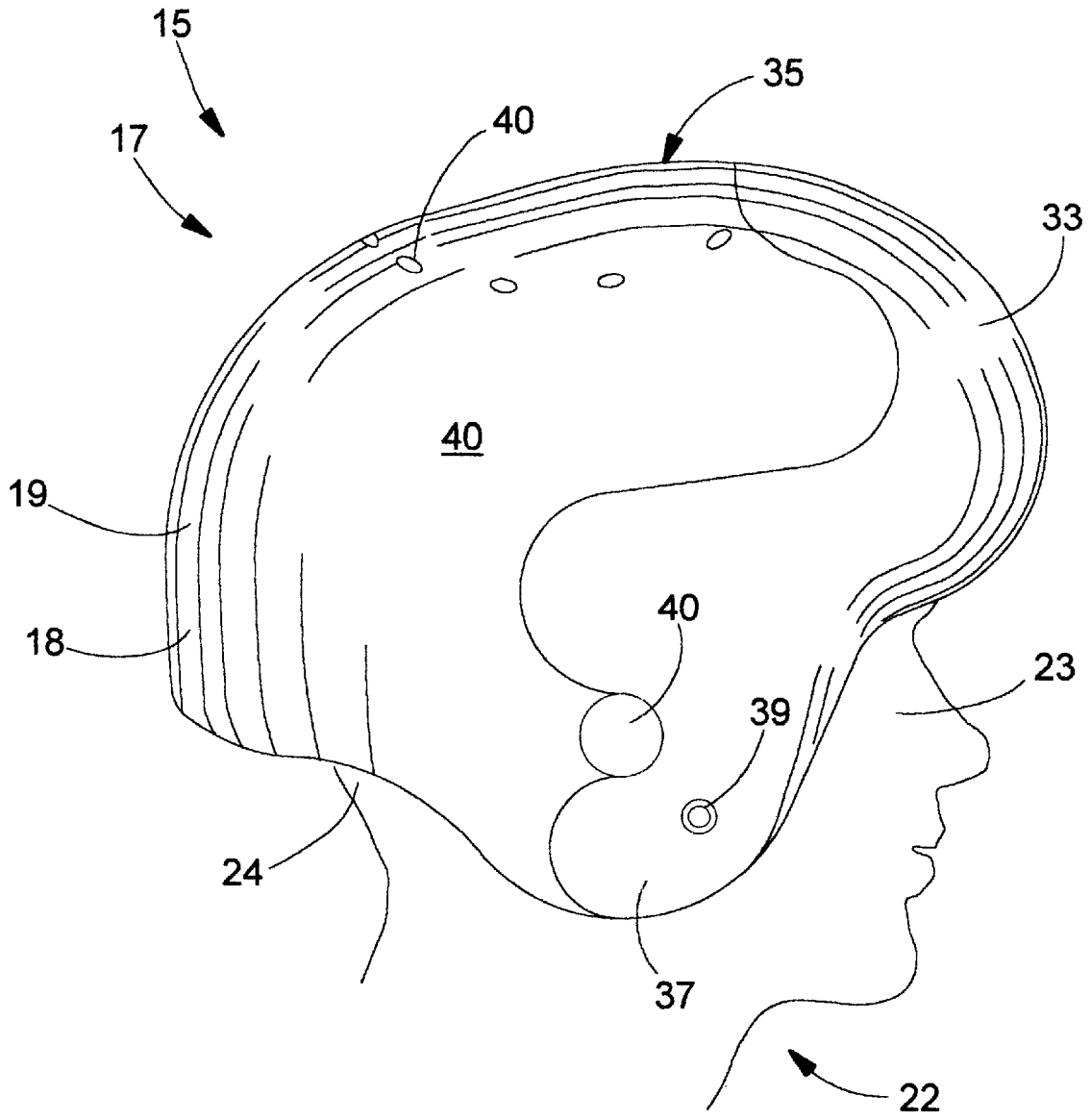
FIG. 3 is a side view of a sport helmet, shown worn by a user, according to an embodiment of the invention.
Figure 4:
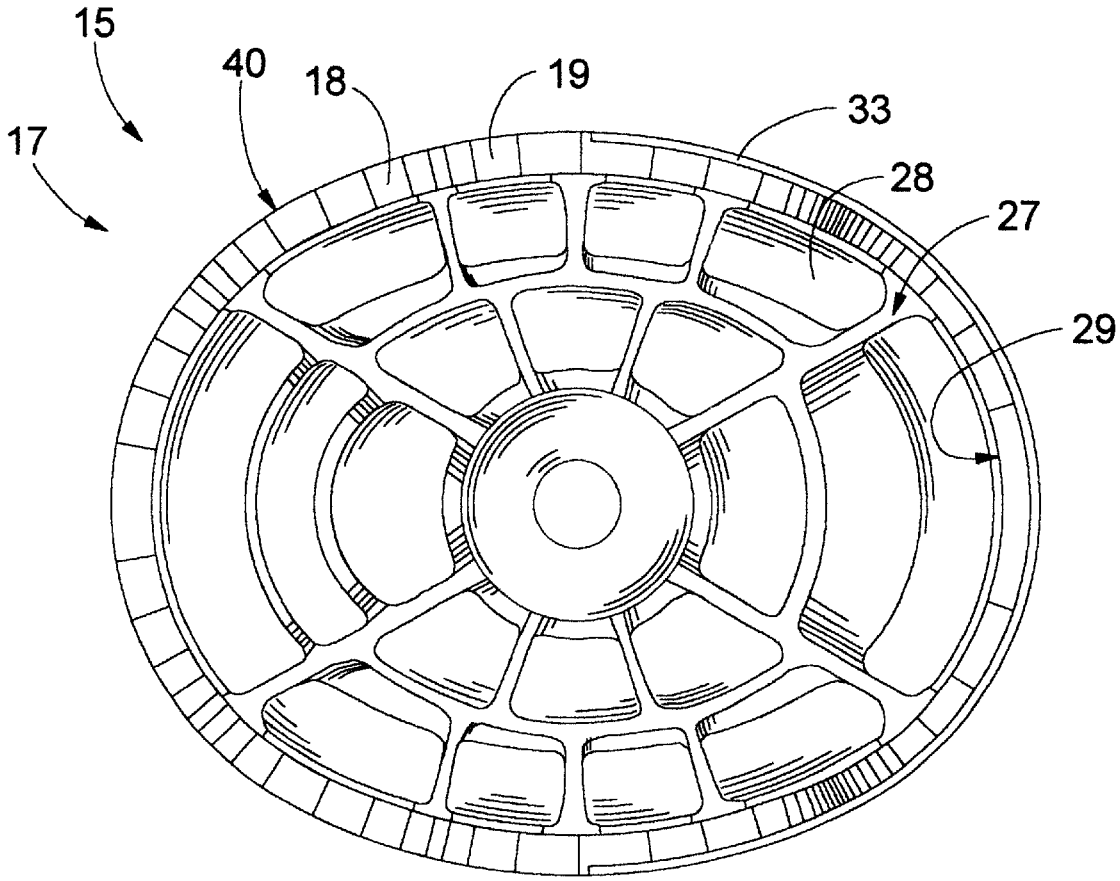
FIG. 4 is a horizontally sectioned view of a sport helmet, shown worn by a user, according to an embodiment of the invention.
Figure 5:
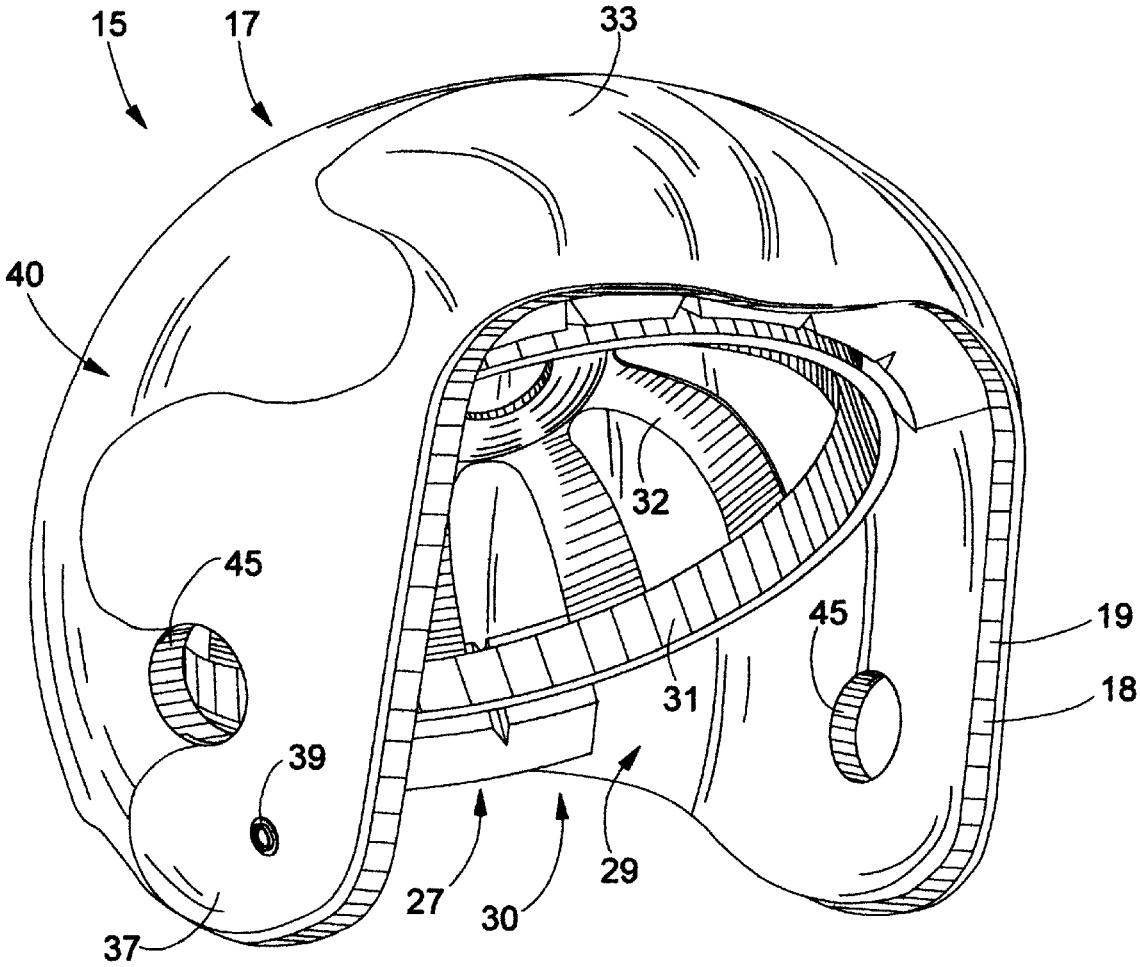
FIG. 5 is a perspective view of a sport helmet, according to an embodiment of the invention.
Figure 6:
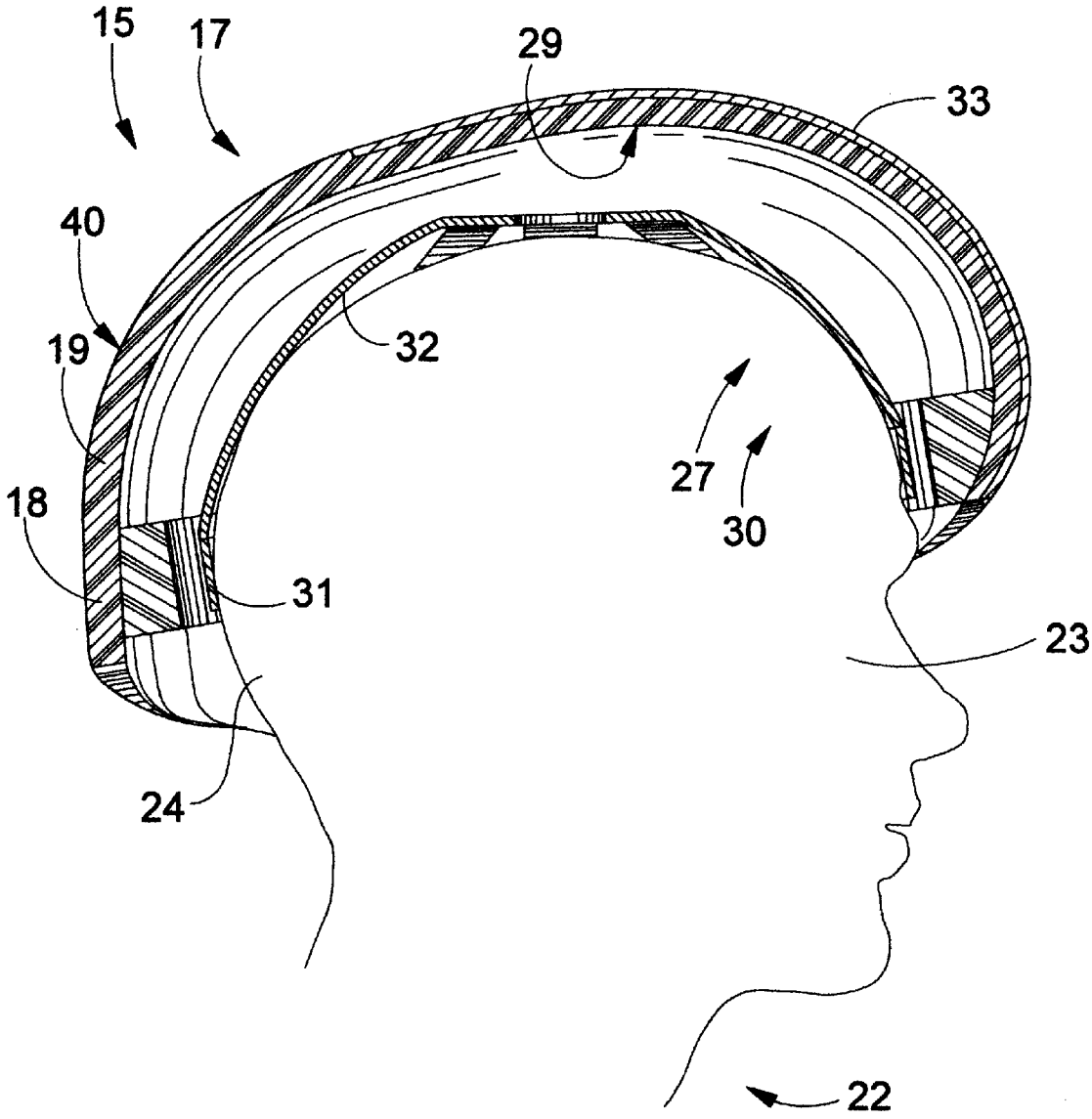
FIG. 6 is a vertically sectioned view of a sport helmet, shown worn by a user, according to an embodiment of the invention.
Figure 7:
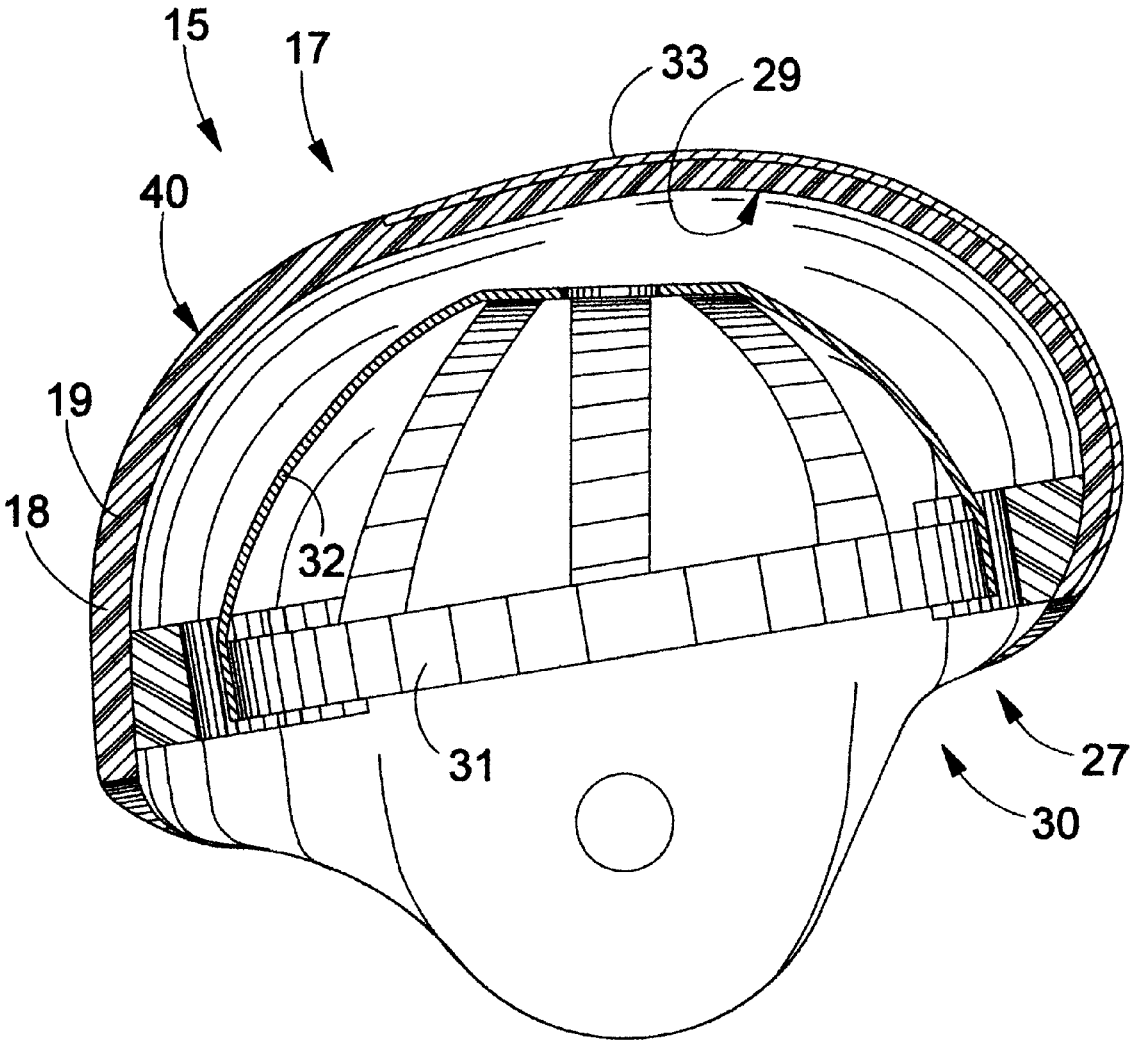
FIG. 7 is a vertically sectioned view of a sport helmet, according to an embodiment of the invention.
Figure 8:
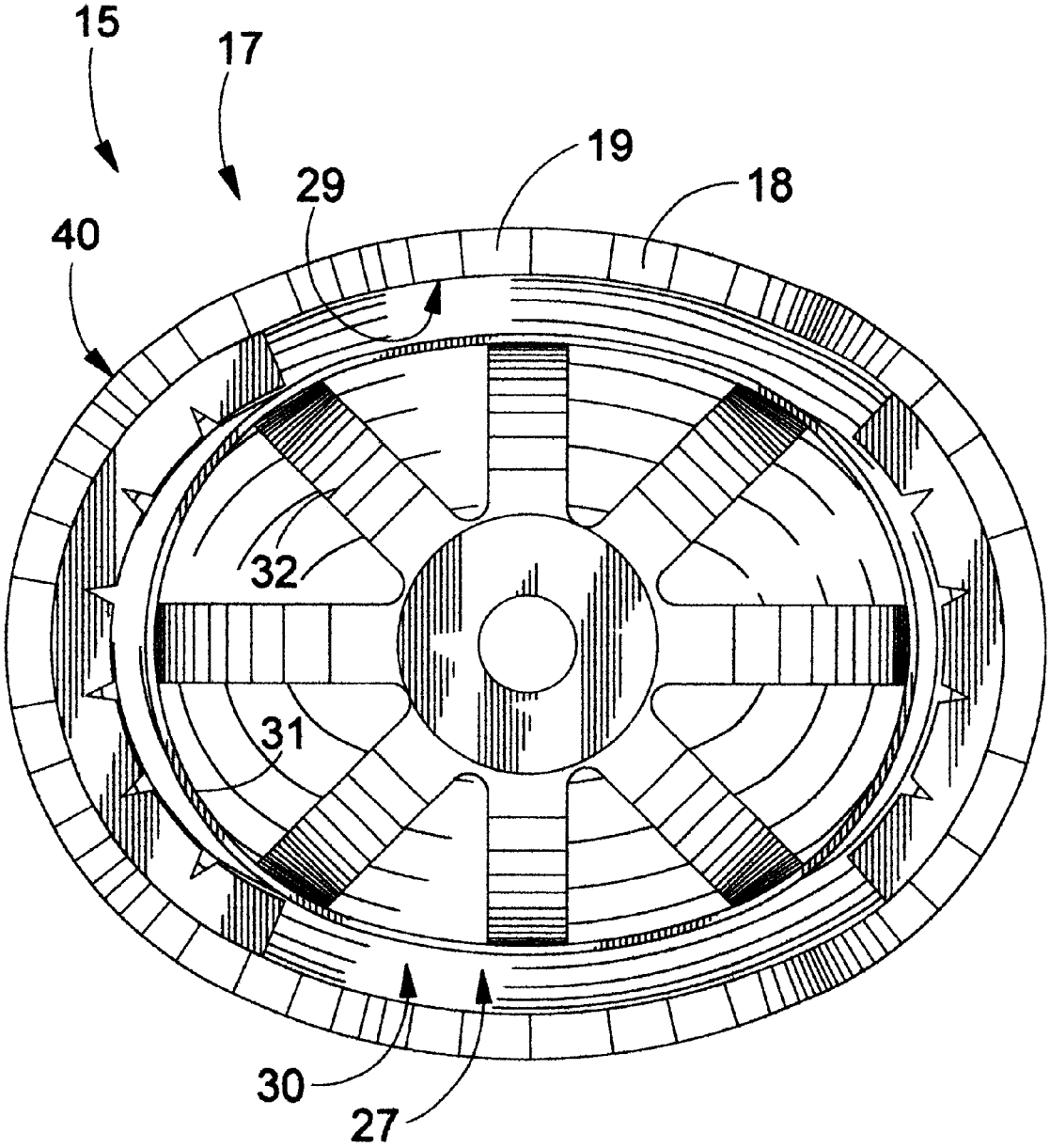
FIG. 8 is a horizontally sectioned view of a sport helmet, according to an embodiment of the invention.

FIGS. 2, 3, and 6 show a user 22 wearing the helmet 15 of the present invention. The helmet is formed to fit on the head 23 of the user, and specifically over the cranium 24 of the user. The helmet also includes a cranial support 27, as shown in FIGS. 1, 2, 4 through 9, and 11. The cranial support is preferably a pad 28 of soft foam, as shown in FIGS. 1, 2, 4 and 11. The cranial support attaches to an interior surface 29 of the shell 17.

The cranial support 27 is most preferably a plurality of cranial supports. Each cranial support contacts the head 23 of the user 22 to support the shell 17. Each of the plurality of cranial supports are preferably attached to the interior surface of the shell with a pad attachment that is most preferably an adhesive layer. Alternatively, the pad attachment can be a hook and loop attachment, such as VELCRO™. As an additional alternative, as shown in FIGS. 5 through 9, the cranial support can be a cranial suspension system 30. The cranial suspension system is a conventional head ring 31 and webbing cap 32, often employed in safety hats and helmets. The cranial suspension comfortably and safely separates the head of the user from the interior surface of the shell.

In an alternative embodiment, the cranial support 27 can be an element of the single, homogenous shell 17. Conventional pads, preferably attached to the shell with either an adhesive or hook and loop attachment, can be employed to size the helmet 15 to the head 23 of a specific user 22.

A significant feature of the shell 17 is that it lacks a supporting, non-homogeneous infrastructure imbedded within the shell, as employed in other soft foam helmets, typified by the disclosures of U.S. Pat. Nos. 5,088,130 and 5,745,923. These infrastructures are expensive and difficult to produce. The inventor of the present invention has found that by employing the shell 17 of the soft foam material 19 coupled with a set of the cranial supports 27, a strong and safe helmet is achieved.

In a preferred alternative embodiment of the present invention, the shell 17 includes an insert plate 33, as shown in FIGS. 1 through 7 and 9 through 11. The insert plate molds onto the exterior surface 35 of the shell. The insert plate is exposed, but inset into the homogeneous component 18. To blend in with the exterior shape of the shell and prevent the insert plate form catching on objects that the helmet 15 may brush up against, the insert plate is substantially flush with the exterior surface of the shell. The insert plate is formed from a substantially rigid material and is ideal for heading a soccer ball or deflecting impacts with solid objects, such as other helmets.

Especially with the insert plate 33, the shell 17 of the helmet 15 does not require reinforcing elements to help in protecting the head 23 of the user 22. The soft foam material 19 of the helmet is dense enough to hold together and maintain its shape without the need for reinforcing elements or the aid of the cranial supports 27. By employing the insert plates, the helmet of the present invention can provide approximately the same level of impact protection as a conventional hard shell helmet. With the reinforcing elements or supporting infrastructure absent within the shell, the helmet of the present invention weighs less and is more easily and economically manufactured, as compared to many conventional helmets.

Figure 9:
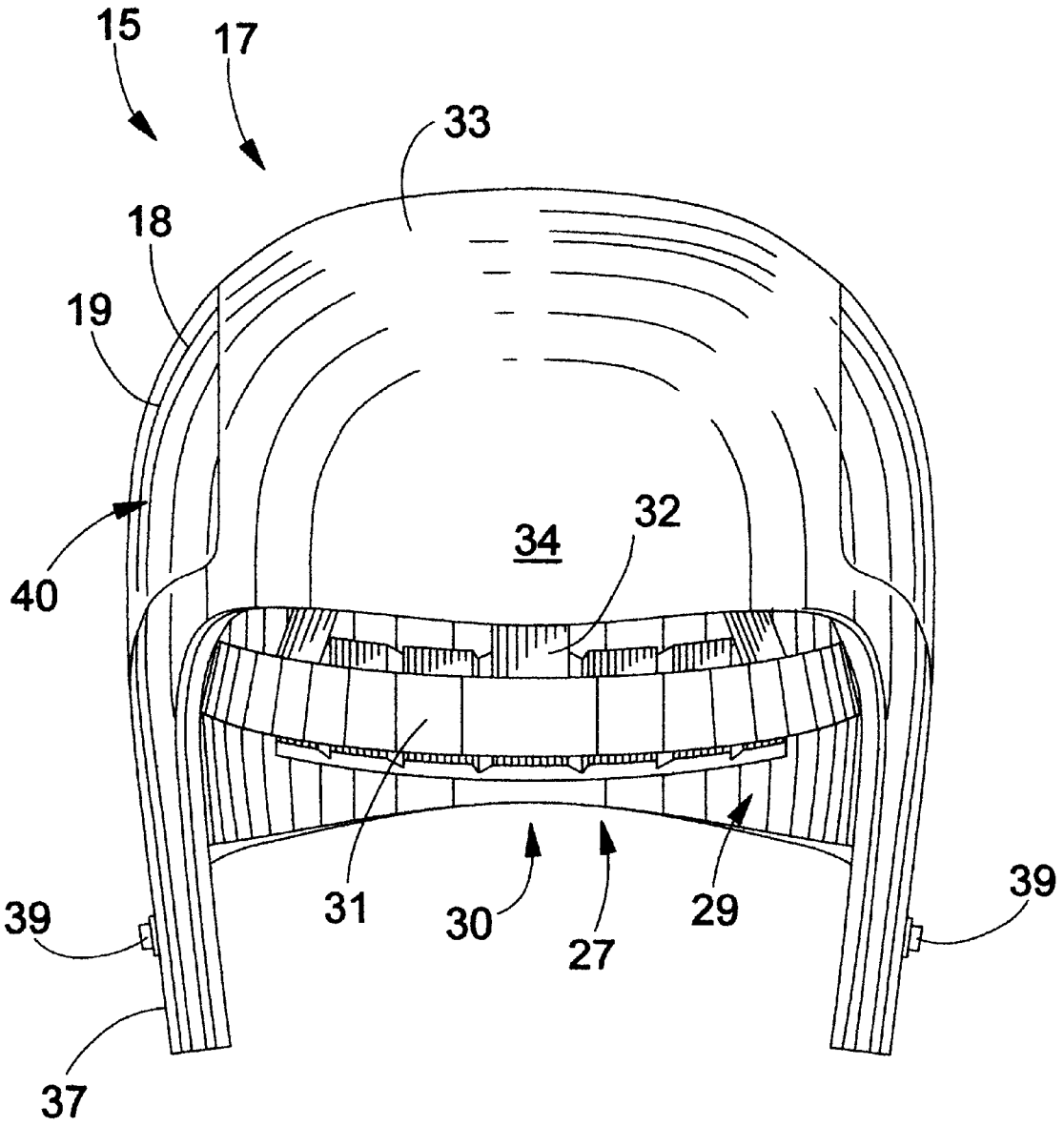
FIG. 9 is a front view of a sport helmet, according to an embodiment of the invention.
Figure 10:
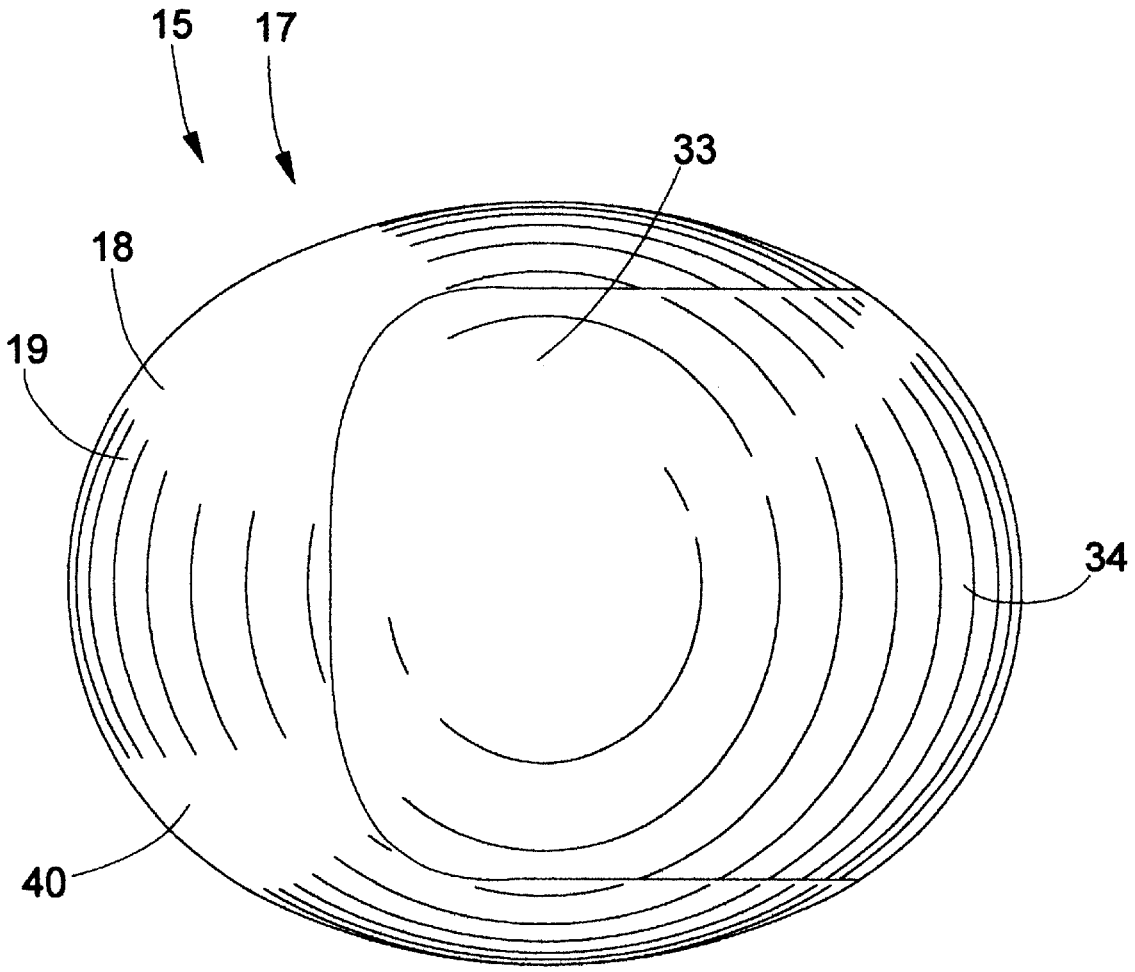
FIG. 10 is a top view of a sport helmet, according to an embodiment of the invention.

The insert plate 33 can be any substantially rigid material. Light gauge metals or resilient plastics are considered as alternatives for the insert plate. A most preferred material for the insert plate is considered to be stainless steel or alternatively titanium. As shown in FIGS. 1, 3, and 5, the insert plate can also lend a decorative feature to the helmet 15. The insert plate preferably extends downward over most of the forehead and upward over the top of the shell 17, as shown in FIGS. 1, 9 and 10. The insert plate is most preferably positioned proximate the forehead of the user, toward the top and forward portion of the helmet, herein referred to as a frontal surface 34 of the shell.

When the helmet 15 is employed as a soccer helmet, a functional purpose of the insert plate 33 is to simulate the hardness of the head for "heading" the ball. In this use, a foremost purpose of the helmet is to be able to head the ball without injury to the head and the brain. The portions of the shell 17 that are not clad by the insert plate are soft to minimize injuries on other parts of a body that are struck by the helmet.

To further supplement the structural strength of the shell 17, the helmet 15 of the present invention can include a holding plate 37, as shown in FIG. 1. The holding plate, like the insert plate 33, the holding plate is mounted flush to the exterior surface 35 of the shell. The holding plate is molded to the shell, at least partially exposing the holding plate to the exterior surface of the shell. The holding plate receives a helmet attachment, such as a chin strap or a face guard (not shown). Other attachments to the holding plate could include face shields, eye shields and light mounts.

Figure 11:
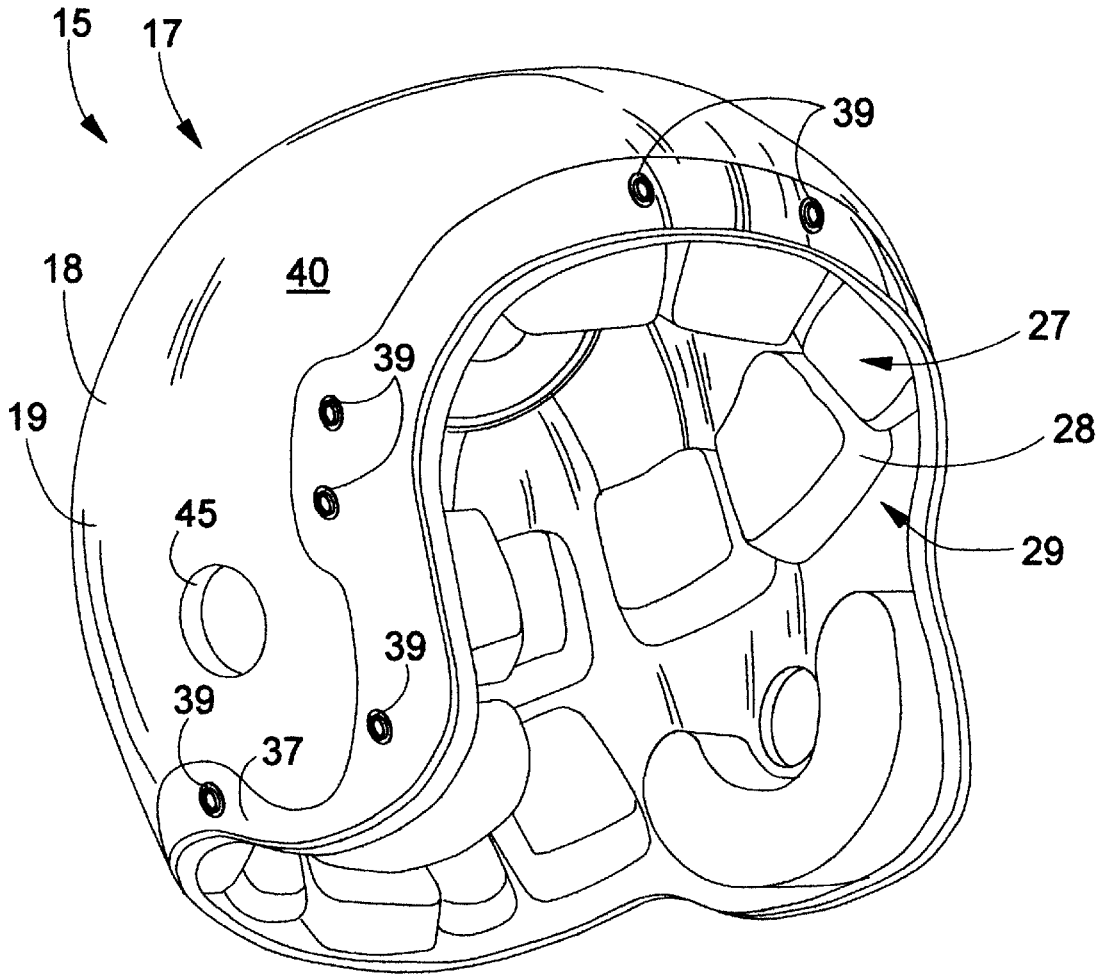
FIG. 11 is a perspective view of a sport helmet, according to an embodiment of the invention.

The holding plate 37 can be incorporated into the insert plate 33, as shown in the preferred embodiment of FIGS. 1, 3, 5 and 9, which show the insert plate coupled with the holding plate for a chin strap or guard. Multiple holding plates can also be combined as shown in FIG. 11, to include a multiple set of attachments 39 for a face shield and chin strap. The holding plate 37, and the insert plate 33 can be colored, painted or receive decals or insignia. Also, a pigment can be easily added to the soft foam material 19 of the shell 17, so that the helmet will match any desired team colors. Preferably, any portion of the homogenous component 18 of the shell that was in contact with the forming mold will have a "skin" 40. This skin has a sheen that will give the helmet an aesthetically pleasing appearance, similar to conventional helmets.

The helmet 15 of the present invention preferably includes ear holes 45, as shown in FIGS. 1, 3, 5, 7 and 11. Vents 48 may also be molded into the helmet, as shown in FIGS. 2 and 3. The number and size of these vents can be varied by the manufacturer of the helmet to suit the particular use and preference of the user.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A sport helmet including:

a shell comprising a molded soft foam material, the shell formed of a single, homogeneous component, and the shell absent supporting infrastructure imbedded within the shell;

the soft foam having a pliable form to provide a compressive resistance against impact of a substantially solid object into the shell;

a cranial support attached to an interior surface of the shell, the cranial support for contacting the head of a user to support the shell; and the shell includes an insert plate molded into the shell, the insert plate exposed at an exterior surface of the shell, and the insert plate comprised of a substantially rigid material.

2. The sport helmet of claim 1, wherein the insert plate is molded to a frontal surface of the shell.

3. The sport helmet of claim 1, further comprising:

a holding plate molded within the shell, the holding plate partially exposed at an exterior surface of the shell; and a helmet attachment mountable onto the holding plate.

4. The sport helmet of claim 3, wherein the helmet attachment is for receiving a chin guard.

5. The sport helmet of claim 3, wherein the helmet attachment is for receiving a face guard.

6. The sport helmet of claim 3, wherein the holding plate is a plurality of holding plates.

7. The sport helmeth of claim 1, wherein the soft foam material is an injection moldable material.

8. The sport helmet of claim 1, wherein the soft foam material is a polyolefin material.

9. A sport helmet including:

a shell formed of a single, homogeneous component, without an imbedded infrastructure;

the shell comprising a molded soft foam having a pliable form, the pliable form resistant to compression from an impact of a substantially solid object into the shell;

an insert plate molded into the shell and exposed on an exterior surface of the shell, the insert plate comprised of a substantially rigid material; and a cranial support attached to an interior surface of the shell, the cranial support for contacting a user's head.

10. The sport helmet of claim 9, wherein the insert plate is molded to a frontal surface of the shell.

11. The sport helmet of claim 9, further comprising:

a holding plate molded within the shell and partially exposed on an exterior surface of the shell; and a helmet attachment attachable to the holding plate.

12. The helmet of claim 11, wherein the helmet attachment is for receiving a chin guard.

13. The sport helmet of claim 11, wherein the helmet attachment is for receiving a face guard.

14. The sport helmet of claim 11, wherein the holding plate is a plurality of holding plates.

15. A sport helmet including:

a shell formed of a single, homogeneous component, without an imbedded infrastructure;

the shell comprising a molded soft foam having a pliable form, the pliable form resistant to compression from an impact of a substantially solid object into the shell;

the shell including an integral cranial support on an interior surface of the shell, the cranial support for supporting the shell on the head of a user of the sport helmet; and the shell includes an insert plate molded into the shell and exposed on an exterior surface of the shell, the insert plate comprising a substantially rigid material.

16. The sport helmet of claim 15, wherein the insert plate is molded to a frontal surface of the shell.

17. The sport helmet of claim 15, further comprising:

a holding plate molded within the shell and partially exposed on an exterior surface of the shell; and a helmet attachment attachable to the holding plate.

18. The sport helmet of claim 17, wherein the helmet attachment is for receiving a chin guard.

19. The sport helmet of claim 17, wherein the helmet attachment is for receiving a face guard.

20. The sport helmet of claim 17, wherein the holding plate is a plurality of holding plates.

* * * * *